US008838005B2

(12) United States Patent
Kashiwakura et al.

(10) Patent No.: US 8,838,005 B2
(45) Date of Patent: Sep. 16, 2014

(54) LOOP BRUSH, LUBRICANT APPLICATION MECHANISM, AND IMAGE FORMING APPARATUS

(75) Inventors: Kuniaki Kashiwakura, Toyohashi (JP); Yoshiki Nakane, Toyokawa (JP); Yohei Ito, Toyokawa (JP)

(73) Assignee: Konica Minolta, Inc., Tokyo (JP)

( * ) Notice: Subject to any disclaimer, the term of this patent is extended or adjusted under 35 U.S.C. 154(b) by 103 days.

(21) Appl. No.: 13/527,976

(22) Filed: Jun. 20, 2012

(65) Prior Publication Data

US 2012/0328347 A1 Dec. 27, 2012

(30) Foreign Application Priority Data

Jun. 21, 2011 (JP) ..... 2011-137275

(51) Int. Cl.
*G03G 21/00* (2006.01)

(52) U.S. Cl.
CPC ..... *G03G 21/0094* (2013.01)
USPC ..... 399/346; 399/287; 399/353; 15/230; 492/29

(58) Field of Classification Search
USPC ..... 399/346, 350, 353, 287; 492/29, 32, 43, 492/44; 15/230
See application file for complete search history.

(56) References Cited

U.S. PATENT DOCUMENTS 5,652,649 A * 7/1997 Ikegawa et al. ..... 399/175
5,879,497 A * 3/1999 Nakahara et al. ..... 156/99
2003/0002896 A1* 1/2003 Akiba ..... 399/353
2003/0219289 A1* 11/2003 Kawahara et al. ..... 399/349
2009/0103944 A1 4/2009 Shintani et al.
2011/0164909 A1* 7/2011 Nakane et al. ..... 399/346

FOREIGN PATENT DOCUMENTS

| | | |
|---|---|---|
| CN | 101414149 | 4/2009 |
| JP | 6-289759 | 10/1994 |
| JP | 2007-47514 | 2/2007 |
| JP | 2010-117523 | 5/2010 |
| JP | 2010-204500 | 9/2010 |
| WO | 2010032572 | 3/2010 |

OTHER PUBLICATIONS

Notice of Grounds of Rejection mailed Oct. 8, 2013, directed to JP Patent Application No. 2011-137275; 7 pages.
Office Action issued in CN 201210210476.9 and dated Jun. 16, 2014 (CNOA).
English translation of the grounds for rejection in the CNOA, Jun. 16, 2014.

* cited by examiner

*Primary Examiner* — David Gray
*Assistant Examiner* — Francis Gray
(74) *Attorney, Agent, or Firm* — Lucas & Mercanti, LLP

(57) ABSTRACT

A loop brush includes a shaft and a ribbon having loop-shaped fiber bundles arranged regularly on a base cloth. The ribbon is wound around the shaft at a prescribed angle. An arrangement angle that is an angle of an arrangement line, which is a straight line connecting adjacent fiber bundles, with respect to a longitudinal direction of the ribbon differs from a winding angle that is an angle of the longitudinal direction of the ribbon with respect to a circumferential direction of the shaft.

12 Claims, 10 Drawing Sheets

LOOP BRUSH, LUBRICANT APPLICATION MECHANISM, AND IMAGE FORMING APPARATUS

This application is based on Japanese Patent Application No. 2011-137275 filed with the Japan Patent Office on Jun. 21, 2011, the entire content of which is hereby incorporated by reference.

BACKGROUND OF THE INVENTION

1. Field of the Invention

The present invention relates to a loop brush for use in an electrophotographic image forming process, a lubricant application mechanism using the loop brush, and an image forming apparatus using the lubricant application mechanism.

2. Description of the Related Art

Improvement of image quality such as high resolution and photographic reproducibility has been demanded in order to provide the quality comparable to that of offset printing, using an electrophotographic image forming apparatus. Reduction in toner particle size and spheronization of toner are known as one of effective means for satisfying the demand for improvement of image quality.

On the other hand, with spheronization and reduction in particle size, toner easily slips through between an image carrier and a cleaning blade for scraping off residual toner. This is because the reduction in toner particle size increases adhesion due to Van der Waals force between toner and the image carrier, and toner reduced in size more easily intrudes between the cleaning blade and the image carrier (nip section). In addition, with spheronization of toner, toner easily rolls on between the cleaning blade and the image carrier and easily intrudes into the nip section, accordingly.

If toner slips between the cleaning blade and the image carrier, that is, if poor cleaning occurs, the residual toner is transferred onto an image during the next process to form black streak-like image noise, or the residual toner blocks light during the exposure step to prevent formation of a latent image, resulting in image noise. Such poor cleaning is an event to avoid.

Then, a technique for facilitating cleaning of spheronized toner or toner reduced in particle size is proposed, in which a material for reducing a friction coefficient of an image carrier is supplied onto the image carrier (for example, Japanese Laid-Open Patent Publication No. 2007-047514). As an example of this technique, it is known to apply a lubricant made of fatty acid metallic salt such as zinc stearate onto a surface of the image carrier using a brush. The application of a lubricant on the image carrier reduces the adhesion and friction force of toner on the image carrier, and therefore, toner can be scraped off sufficiently even only with a cleaning blade.

As a method of supplying a lubricant to an image carrier, it is known to externally add fatty acid metallic salt (for example, zinc stearate) in a powder state to toner and supply the external additive as well as toner to the image carrier through development to form a thin film with a cleaning blade. This lubricant development supply method does not require a special structure for supplying a lubricant and is thus very effective in terms of cost and space. Therefore, low-speed/mid-speed image forming apparatuses often adopt this method.

However, in the lubricant development supply method described above, the lubricant, which is externally added, is often charged by friction with toner while being agitated in the development device, so that the supply of lubricant becomes uneven. More specifically, when being charged to the same polarity as toner, the lubricant is supplied to an image section on the image carrier, whereas when being charged to the opposite polarity to toner, the lubricant is supplied to a non-image section on the image carrier. Therefore, when the same image is successively printed for a long time, the supply of lubricant becomes uneven to cause variations of the friction coefficient.

When low-density images continue for a long time, the supply of lubricant to the cleaning blade reduces per se, and, as a result, the friction coefficient is not reduced enough. On the other hand, if the amount of lubricant externally added is increased, the lubricant easily transfers to the carrier in the development device. If the lubricant transfers, the charged property of toner is lost, causing oppositely charged toner. The oppositely charged toner causes a phenomenon called "fog noise" in which toner is developed in the non-image section. Furthermore, the lubricant is applied to the development roller to reduce the friction coefficient and prevent proper conveyance of developer. This will cause inconvenience such as reduced image density in high-density images.

As another method of supplying a lubricant to an image carrier, a solid lubricant obtained by solidifying fatty acid metallic salt (for example, zinc stearate) is pressed against a rotatable brush, and the lubricant scraped off with the brush is applied to an image carrier (lubricant application method).

This lubricant application method requires, in addition to a cleaning blade, a solid lubricant and a roll-like brush for scraping off the solid lubricant to be supplied to an image carrier as well as a component for holding them and a spring for pressing. Thus, the cost is increased, and more space is required. However, the stability of applying a lubricant is relatively high because the lubricant is actively applied to the image carrier. Another advantage is that environmental dependency is reduced.

A straight-bristle brush is generally used as the brush for use in the lubricant application method. The straight-bristle brush is like a toothbrush, in which fiber tip ends are present on the surface of the brush. Because of the fibers being independently present, the brush surface can be kept in a relatively dense state and can be brought into abutment with the image carrier uniformly. While keeping a uniform abutment state with the image carrier, the straight-bristle brush has the following problem in grinding the lubricant.

The solid lubricant having a soft surface is shaved and consumed through grinding. In the initial state, the solid lubricant is shaved relatively evenly. However, with consumption, depressions and projections are gradually formed on the surface. When depressions and projections are formed, a plurality of fibers are concentrated on the depressions thereby to accelerate grinding in the depressions. On the other hand, the fibers do not come into abutment with the projections. Therefore, as the consumption proceeds, the depressions and projections of the lubricant become noticeable. As the consumption further proceeds, the depressions cannot be ground because of reduction in pressing force against the lubricant. As a result, the amount of supply of the lubricant to the image carrier is significantly reduced, and the lubricant does not function any longer.

In order to prevent this state, it is effective to increase the fiber density of the brush. However, when the fiber density is increased, toner accumulates in the brush thereby reducing the capability of scraping off the lubricant. Moreover, the brushing force against the image carrier increases, which gives damages such as streaky scratches on the image carrier and increasing wear.

A loop brush may be used instead of a straight-bristle brush in the lubricant application method as described above (for example, Japanese Laid-Open Patent Publication No. 2010-117523). The loop brush, formed like terry cloth, is formed by making bundles of fibers in a loop shape. With the use of such a loop brush, the lubricant can be ground evenly.

The reason for this is as follows. In the loop brush, unlike the straight-bristle brush, the fibers are formed in bundles and the rigidity of the fiber bundles is thus high. Therefore, the fiber bundles can grind the lubricant without being affected by some depressions and protrusions of the lubricant. Another factor may be that the fibers are less concentrated on the depressions because the tip ends of the loop brush are formed into loops.

With the use of the loop brush, the lubricant is evenly ground. Accordingly, the supply to the image carrier is not abruptly reduced even when the consumption proceeds. The lubricant can be thoroughly used, and therefore, even a relatively small lubricant is highly durable.

A method of producing a loop brush will be described briefly. First, a bundle of several fibers is repeatedly passed upward and downward through a long ribbon-like cloth (hereinafter also referred to as "base cloth") having warp and weft woven in a mesh structure. The fiber bundle is protruded longer on one side of the base cloth to form a loop shape. Then, the long ribbon having loops is wound around a metal shaft of a brush at a prescribed angle, which is uniquely determined according to the ribbon width and the shaft diameter, to form a roll shape.

As described above, the loop brush is formed by bundling a plurality of fibers, so that the fibers do not spread on the brush surface as in the straight-bristle brush and the fiber bundles are regularly distributed. Therefore, the fiber bundles may be lined up in the circumferential direction of the brush, depending on the angle of winding the ribbon. In other words, the fiber bundles may not be present in some places in the circumferential direction of the brush.

If the fiber density of the brush is reduced, the distance (arrangement line spacing) between an arrangement line of fiber bundles (a straight line connecting adjacent fiber bundles) and an arrangement line adjacent thereto is increased. Then, even when the arrangement line is at an angle with the circumferential direction, the arrangement line may not intersect the adjacent arrangement line in one rotation of the brush. In such a state, a portion not in contact with the fiber bundles of the brush periodically appears in the longitudinal direction of the image carrier (irregular abutment occurs). As a result, the supply of the lubricant to the image carrier becomes uneven, which appears as streak noise mainly in a halftone image.

On the other hand, the uneven abutment can be effectively prevented by increasing the fiber density of the brush. However, in this case, toner may be deposited in the brush to prevent the lubricant from being scraped off, as is the case with the use of the straight-bristle brush as described above.

SUMMARY OF THE INVENTION

The present invention is made to solve the problem above. An object of the present invention is to provide a loop brush suitable for a lubricant application method, a lubricant application mechanism using the loop brush, and an image forming apparatus using the lubricant application mechanism.

A loop brush according to an aspect of the present invention includes a shaft and a ribbon having loop-shaped fiber bundles arranged regularly on a base cloth. The ribbon is wound around the shaft at a prescribed angle. An arrangement angle that is an angle of an arrangement line, which is a straight line connecting adjacent fiber bundles, with respect to a longitudinal direction of the ribbon differs from a winding angle that is an angle of the longitudinal direction of the ribbon with respect to a circumferential direction of the shaft.

Preferably, the ribbon is wound such that, for a group of arrangement lines defined by an angle closest to a rotational direction of the shaft, an arrangement line at least intersects an arrangement line adjacent thereto in one rotation of the ribbon around the shaft.

Further preferably, for a group of arrangement lines defined by an angle closest to a rotational direction of the shaft, an arrangement line spacing Lp that is the shortest distance between adjacent arrangement lines satisfies $Lp \leq L \cdot \sin(|\phi-\theta|)/\sin \phi$, where the winding angle is $\phi$, the arrangement angle is $\theta$, and a width of the ribbon is L.

Further preferably, the arrangement line spacing Lp is 0.5 mm or more.

A lubricant application mechanism according to another aspect of the present invention includes the loop brush as described above and a solid lubricant arranged so as to be pressed against the loop brush.

An image forming apparatus according to a further aspect of the present invention includes the loop brush as described above, a solid lubricant arranged so as to be pressed against the loop brush, an image carrier supplied with part of the solid lubricant with rotation of the loop brush, and a cleaning device in abutment with the image carrier.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
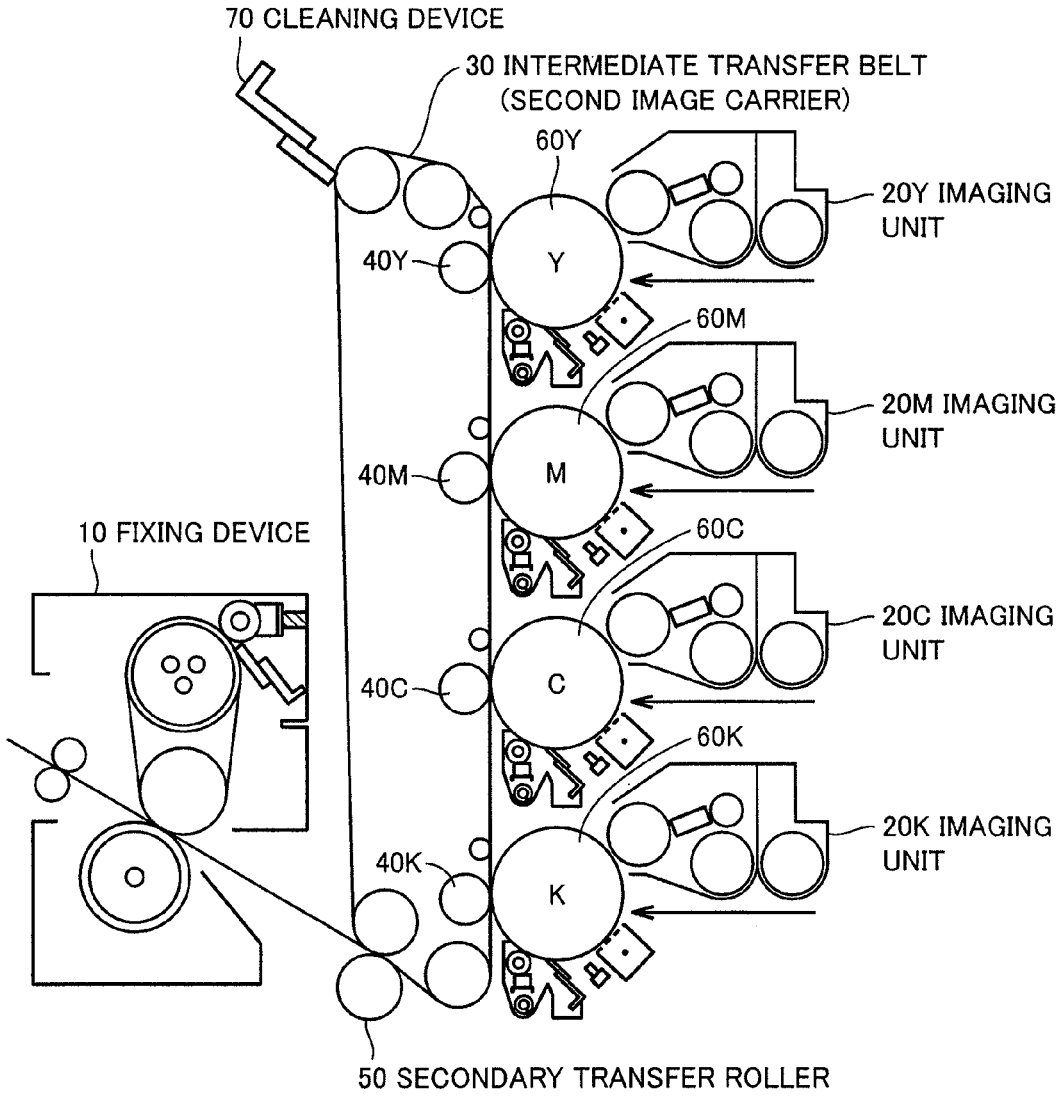
FIG. 1 is a schematic diagram showing a main configuration of an image forming apparatus to which a loop brush according to an embodiment of the present invention is applied.

Embodiments of the present invention will now be described in detail with reference to the drawings. It is noted that the same or corresponding parts in the figures are denoted with the same reference numerals, and a description thereof will not be repeated.

[A. Overview]

A loop brush according to an embodiment of the invention is directed to a lubricant application brush of a lubricant application mechanism and is directed to a configuration for preventing streak noise due to uneven supply of lubricant and density variations due to brush contamination. The loop brush is configured such that an arrangement angle $\theta \neq a$ winding angle $\phi$, where the arrangement angle $\theta$ is the angle of a straight line connecting adjacent fiber bundles (arrangement line) with respect to the longitudinal direction of a ribbon, and the winding angle $\phi$ is the angle of the longitudinal direction of the ribbon with respect to the rotational circumferential direction vertical to the rotation axis of a shaft in a state in which the ribbon is wound around the shaft.

The winding angle $\phi$ is set such that the arrangement line having the angle closest to the rotational direction of the brush at least intersects the adjacent arrangement line in one rotation of the shaft.

When this relation is represented as a mathematical expression, for the arrangement line spacing Lp of the arrangement line having the angle closest to the rotational direction of the brush (the shortest distance between a reference arrangement line and an arrangement line parallel to and in proximity to the reference arrangement line), the winding angle $\phi$, and the ribbon width L, the relation below is satisfied.

$$Lp \leq L \cdot \sin(|\phi - \theta|)/\sin\phi$$

$$Lp \geq 0.5$$

The lubricant application brush according to the present embodiment is a rotatable brush configured to scrape off the solidified lubricant and supply the scraped lubricant to a toner image carrier (image carrier). A loop brush as described above can be used as the brush.

The image forming apparatus according to the present embodiment has an image carrier (image carrier) for selectively carrying toner and holding a toner image. The toner image is transferred from the image carrier to a transfer medium (intermediate transfer belt), and residual toner left on the image carrier is thereafter cleaned in preparation for subsequent image formation. The lubricant application brush as described above is used at a location upstream or downstream from a cleaning device.

[B. Apparatus Configuration]

An electrophotographic image forming apparatus to which the loop brush according to an embodiment of the present invention is applied will now be described. The loop brush according to the present embodiment is applicable to a variety of image forming apparatuses (copiers, printers, facsimile machines, Multi-Function Peripherals (MFP)) using the electrophotographic technique.

Figure 2:
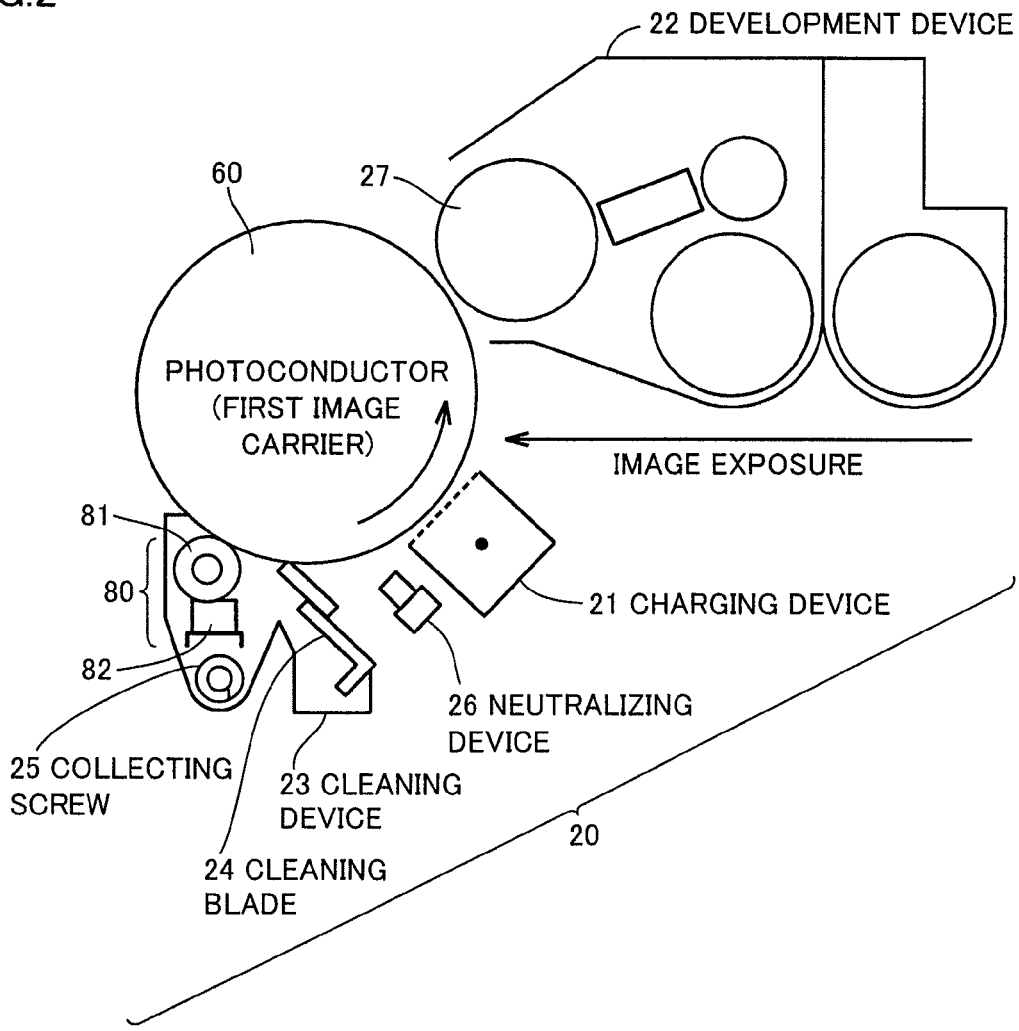
FIG. 2 is a schematic diagram showing a configuration of an imaging unit shown in FIG. 1.

FIG. 1 is a schematic diagram showing a main configuration of an image forming apparatus to which the loop brush according to an embodiment of the present invention is applied. FIG. 2 is a schematic diagram showing a configuration of an imaging unit shown in FIG. 1. In FIG. 1 and FIG. 2, a tandem-type four-color image forming apparatus is shown as an example of the electrophotographic image forming apparatus. However, the present invention is not limited thereto and is applicable to monochrome or rotary-type color image forming apparatuses.

Referring to FIG. 1, a main structure for electrophotographic image formation includes a fixing device 10, image forming units of each color 20Y, 20M, 20C, and 20K, an intermediate transfer belt (second image carrier) 30, primary transfer rollers 40Y, 40M, 40C, and 40K, a secondary transfer roller 50, image carriers (first image carrier) 60Y, 60M, 60C, and 60K, and a cleaning device 70.

Referring to FIG. 2, each of imaging units 20Y, 20M, 20C, and 20K (hereinafter also collectively referred to as "imaging unit 20") for toner images of yellow (Y), magenta (M), cyan (C), and black (K), respectively, includes a charging device 21, a development device 22, a lubricant application mechanism 80, a cleaning device 23 including a cleaning blade 24 and a collecting screw 25, and a neutralizing device 26. These components are arranged in this order along the circumferential direction of each corresponding image carrier 60Y, 60M, 60C, 60K (hereinafter also collectively referred to as "image carrier 60").

In imaging unit 20, charging device 21 uniformly charges the surface of image carrier (first image carrier) 60 to negative polarity and is irradiated with write light (image exposure) modulated according to image data. Then, an electrostatic latent image corresponding to the image data is formed on image carrier 60. Toner charged by friction to negative polarity is supplied to image carrier 60 with the electrostatic latent image by development device 22 for development. In other words, a toner image corresponding to the electrostatic latent image is formed on the image carrier. Here, reversal development is performed, in which a voltage of negative polarity (development bias) is applied to a development roller 27 for supplying toner from development device 22, and toner is selectively supplied to image carrier 60 having a potential decreased by exposure.

The toner image formed on image carrier 60 is electrostatically transferred to intermediate transfer belt 30 by the corresponding primary transfer roller 40Y, 40M, 40C, 40K (hereinafter also collectively referred to as "primary transfer roller 40"). The electrostatic transfer is realized by electrostatic attraction force produced by the voltage applied to primary transfer roller 40.

Van der Waals force acts between the image carrier and toner because they are charged as described above. Under the effect of the Van der Waals force, toner that cannot be transferred electrostatically, that is, residual toner, is left on image carrier 60. Cleaning device 23 collects the residual toner. More specifically, cleaning blade 24 of cleaning device 23 scrapes off the residual toner on image carrier 60. Cleaning blade 24 is formed of, for example, polyurethane rubber formed in a sheet. The scraped residual toner is conveyed to the inside of cleaning device 23. The residual toner conveyed to the inside of cleaning device 23 is further conveyed from cleaning device 23 to a waste toner box (not shown) by collecting screw 25 and is collected in the waste toner box.

After cleaning, neutralizing device 26 exposes image carrier 60 entirely to erase the electrostatic latent image left on the surface of image carrier 60. Neutralizing device 26 is typically formed of a light emitting member such as a plurality of LEDs (Light Emitting Diodes) arranged in the longitudinal direction. Radiation of light from the light emitting member to image carrier 60 reduces the potential left on the surface of image carrier 60 so that the history of image (memory image) formed in the previous image formation is not left in the subsequent image formation.

A toner image of a single color is generated through the process above in the corresponding imaging unit 20 of each color (Y, M, C, K) and is successively transferred to intermediate transfer belt 30. Finally, the toner images of each color are superimposed to form a full color image on intermediate transfer belt 30.

The full color image on intermediate transfer belt 30 is further transferred to recording paper by secondary transfer roller 50. Next, fixing device 10 fixes the toner transferred on the recording paper by heating and pressing. The recording paper having the fixed toner image is output to a not-shown tray. On the other hand, the residual toner on intermediate transfer belt 30 is scraped off and collected by the cleaning blade of cleaning device 70.

[C. Lubricant Application Mechanism]

Lubricant application mechanism 80 included in imaging unit 20 shown in FIG. 2 will now be described. Referring to FIG. 2, lubricant application mechanism 80 includes a lubricant application brush 81 using a loop brush described later and a solid lubricant 82 arranged in abutment with lubricant application brush 81. Lubricant application brush 81 is configured so as to press solid lubricant 82.

Lubricant application brush 81, being rotatably driven, scrapes off lubricant from solid lubricant 82 and applies the scraped lubricant onto image carrier 60. More specifically, solid lubricant 82 is scraped off by rotation of lubricant application brush 81 serving as an applicator member and by a pressing force against solid lubricant 82. The scraped lubricant, returned to a powder state, is conveyed to a contact section with image carrier 60.

Solid lubricant 82 is made of fatty acid metallic salt such as zinc stearate, magnesium stearate, or lithium stearate. In the present embodiment, powder zinc stearate is fused and shaped to be used as solid lubricant 82. Solid lubricant 82 is affixed to a holding member made of a sheet metal with a double-faced tape or the like because the fused and shaped lubricant is fragile and breakable as it is. In order to provide a pressing force between lubricant application brush 81 and solid lubricant 82, a pressing member including a compression spring holds and presses solid lubricant 82 against lubricant application brush 81.

The lubricant supplied to the surface of image carrier 60 is thereafter conveyed to cleaning device 23 and receives the abutment force from cleaning blade 24 to form a coating on the surface of image carrier 60. In this manner, the image forming apparatus according to the present embodiment includes image carrier 60 supplied with part of the solid lubricant with the rotation of the loop brush, and cleaning device 23 in abutment with image carrier 60. Because of zinc stearate, the coating is characterized by high release performance (that is, the pure water contact angle on the surface of image carrier 60 is large) and by a small friction coefficient. Because of the high release performance and the low friction coefficient, the transfer performance and cleaning performance can be kept well, and image carrier 60 is prevented from wearing and is prolonged in lifetime.

[D. Lubricant Application Brush]

(d1: Overview)

The loop brush that forms lubricant application brush 81 of lubricant application mechanism 80 will now be described. As described above, the image forming apparatus according to the present embodiment uses a roll-like brush (loop brush) as lubricant application brush 81.

Lubricant application brush 81 may rotate in either direction with respect to the rotational direction of image carrier 60. In the present embodiment, lubricant application brush 81 rotates in a direction in which it slides against image carrier 60, that is, makes a counter rotation, and rotates at a relatively low linear velocity with respect to image carrier 60. For example, lubricant application brush 81 rotates such that the ratio in linear velocity to image carrier 60 is 0.4.

The typical material used for lubricant application brush 81 is conductive polyester. It is assumed that the resistance of the conductive polyester brush is $10^9$ to $10^{10}\Omega$. It is also assumed that the thickness of fiber is 4 T (decitex) and the fiber density is 100 KF/inch$^2$. The material of lubricant application brush 81 may be nylon, acrylic, rayon, and the like.

The rotation shaft of lubricant application brush 81 is formed of metal such as iron. The shaft diameter of lubricant application brush 81 is 6 mm, and the diameter of the brush is 12 mm, by way of example. As described later, the fiber is woven in a base cloth (thickness: about 0.5 mm) and has a length of about 2.5 mm.

(d2: Base Cloth)

The ribbon that forms lubricant application brush 81 (loop brush) will now be described. The ribbon is made of a base cloth and fiber bundles (a plurality of fibers bundled together).

Figure 3:
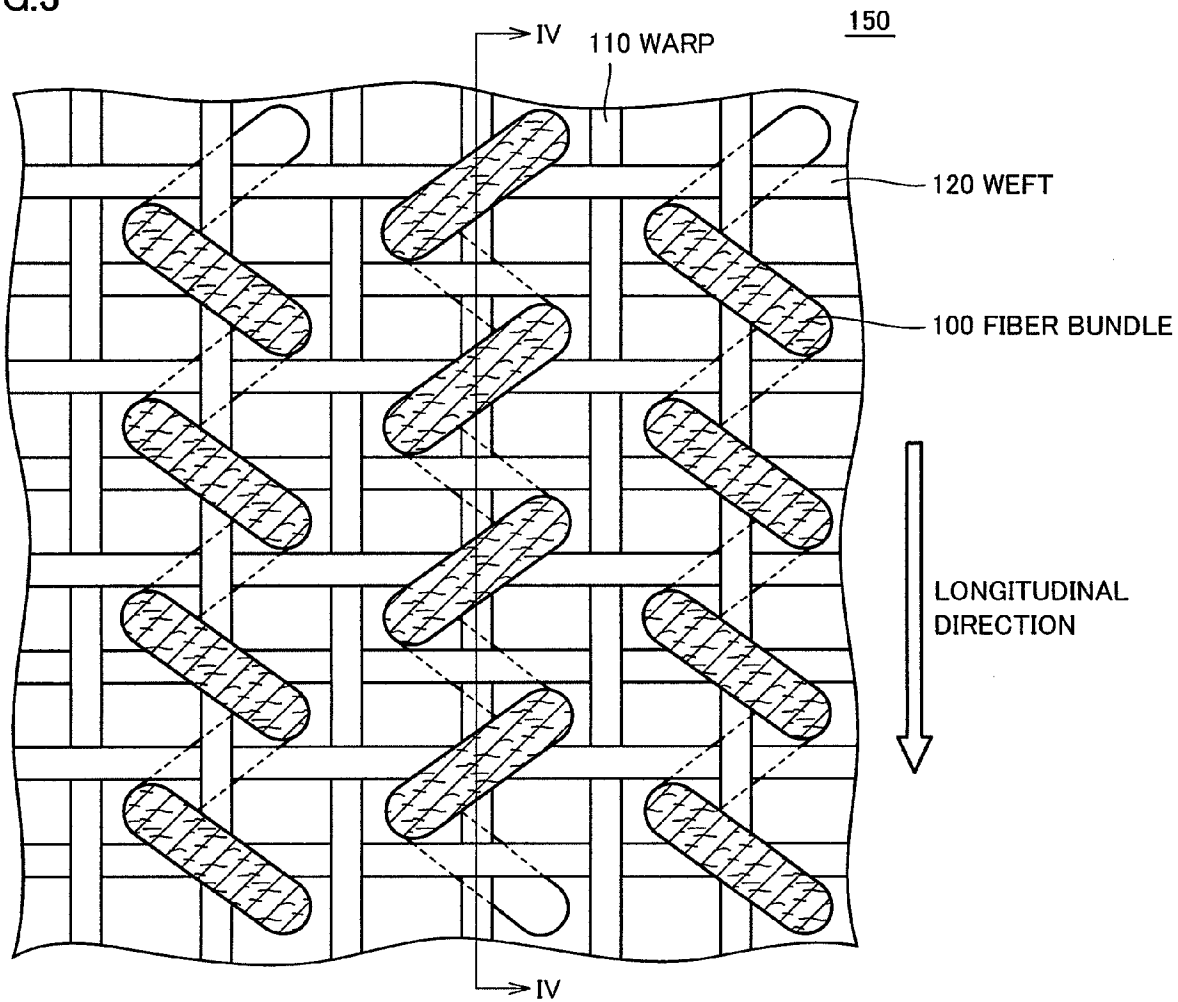
FIG. 3 is a schematic diagram showing a ribbon that forms a lubricant application brush according to the embodiment of the invention, as viewed from above.
Figure 4:
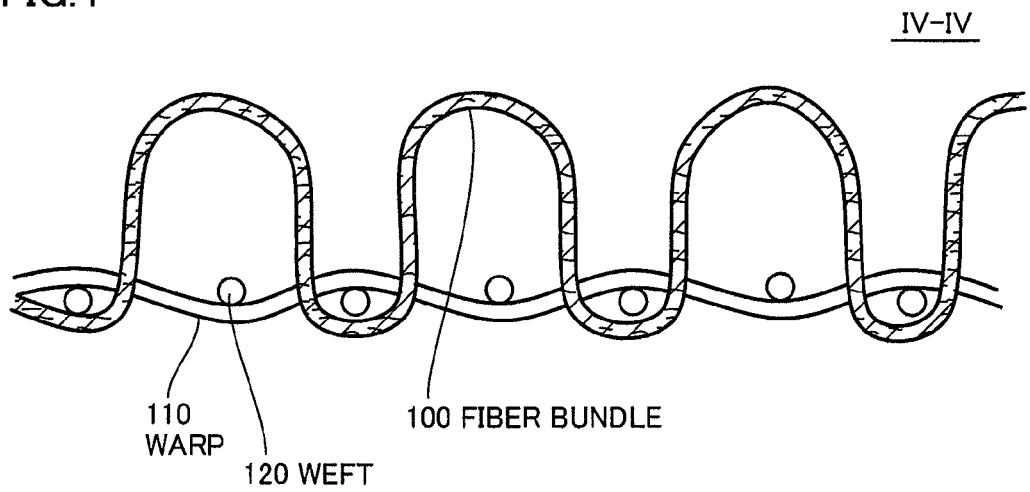
FIG. 4 is a cross-sectional schematic view of the ribbon shown in FIG. 3 taken along IV-IV.

FIG. 3 is a schematic diagram of a ribbon 150 that forms lubricant application brush 81 according to the embodiment of the present invention, as viewed from above. FIG. 4 is a cross-sectional schematic view of ribbon 150 shown in FIG. 3 taken along IV-IV.

Referring to FIG. 3, in ribbon 150 that forms lubricant application brush 81, a fiber bundle 100 is woven according to a prescribed rule in a cloth (hereinafter also referred to as "base cloth") in which warp 110 and weft 120 are alternately woven. Fiber bundle 100 is a bundle of a few tens of fibers (for example, 96 fibers) and is woven so as to run back and forth through a gap between warp 110 and weft 120.

As shown in FIG. 4, when fiber bundle 100 runs on the lower side of the base cloth (warp 110 and weft 120) as viewed on the drawing sheet, fiber bundle 100 is woven in close contact with the base cloth. When fiber bundle 100 runs on the upper side of the base cloth as viewed on the drawing sheet, fiber bundle 100 is woven at a distance from the base cloth. Thus, a loop-like fiber bundle is formed on the upper side on the drawing sheet. The loop-like fiber bundles form a main structure of the loop brush.

As an example of the rule by which fiber bundle 100 is woven, FIG. 3 shows that fiber bundle 100 located next to fiber bundle 100 in a certain row (for example, an even-number row) is woven in a different row (for example, an odd-number row). Specifically, the adjacent fiber bundles 100 are arranged so as to be displaced from each other such that they intersect the base cloth alternately at an even-number row and an odd-number row. In other words, looking at weft 120 at a certain location, when a certain fiber bundle 100 is located above, fiber bundle 100 located adjacent thereto is located below.

In this manner, fiber bundles 100 are arranged so as to be alternately displaced from each other, whereby fiber bundles 100 are woven in a more distributed state. Of course, the rule of weaving fiber bundles 100 is not limited to the one shown in FIG. 3, and any pattern can be used as long as fiber bundles 100 are not concentrated in a particular location.

(d3: Winding Configuration)

Figure 5:
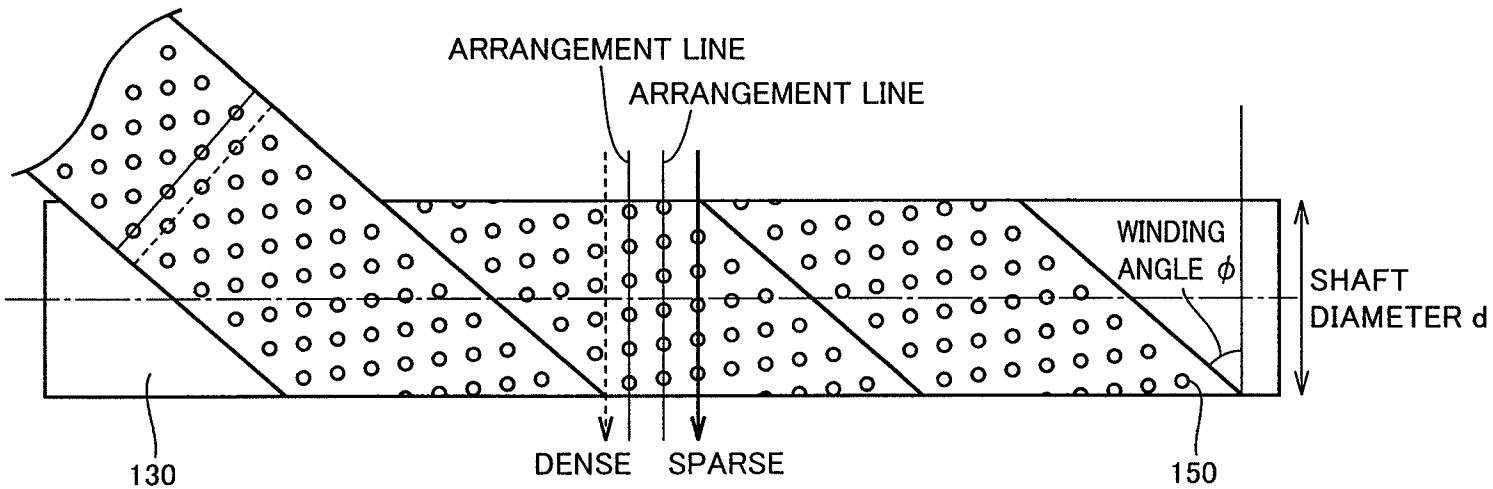
FIG. 5 is a schematic diagram showing a process of winding the ribbon around a shaft.
Figure 6:
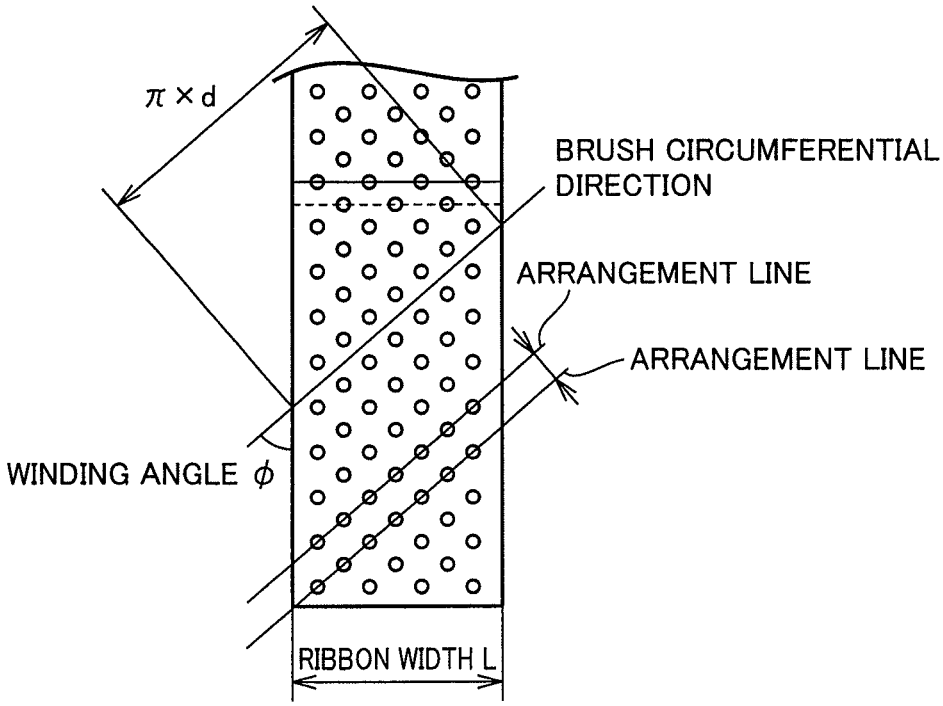
FIG. 6 is a schematic diagram for defining a characteristic constant of the ribbon.

A process of forming lubricant application brush 81 by winding ribbon 150 shown in FIG. 3 and FIG. 4 around a shaft will now be described. FIG. 5 is a schematic diagram showing a process of winding ribbon 150 around a shaft. FIG. 6 is a schematic diagram for defining a characteristic constant of ribbon 150.

Referring to FIG. 5, the loop brush for the lubricant application brush is formed by winding ribbon 150 at a prescribed angle with respect to the axial direction of a cylindrical shaft 130. As shown in FIG. 5, let $\phi$ be the winding angle of ribbon 150 with respect to the rotational circumferential direction (the axially outer circumferential end surface) orthogonal to the rotational axis of shaft 130, and d be the diameter of shaft 130 (shaft diameter).

As shown in FIG. 5, in a case where ribbon 150 is wound around shaft 130 in a single layer (without overlapping), one sheet of ribbon 150 is wound for each rotation around the shaft. Thus, the ribbon width L of ribbon 150 can be expressed by an equation (1) below using the shaft diameter d and the winding angle $\phi$.

$$L=\pi\times d\times\sin\phi \quad (1)$$

In this manner, the loop brush used for lubricant application brush 81 includes loop-like fiber bundles regularly arranged on a base cloth, and a ribbon wound around a shaft at a prescribed angle.

(d4: Problem)

As explained using FIG. 3, fiber bundles 100 are present in ribbon 150 at regular intervals according to a prescribed rule. Therefore, on a straight line connecting two given fiber bundles 100, different fiber bundles 100 line up at regular intervals. Here, a straight line that connects a certain fiber bundle (for example, an even-number row) with a fiber bundle adjacent thereto (closest) (for example, an odd-number row) is defined as "arrangement line."

FIG. 5 shows an example in which the arrangement line in ribbon 150 generally agrees with the circumferential direction of shaft 130 in the state in which ribbon 150 is wound around shaft 130. In the state in which the arrangement line of ribbon 150 generally agrees with the circumferential direction of shaft 130 in this manner, a dense section having a plurality of fiber bundles 100 and a sparse section having no fiber bundle 100 appear periodically (at regular intervals) as viewed in a prescribed range along the rotational axis of shaft 130.

In other words, FIG. 5 shows an example in which the arrangement angle that is the angle of the arrangement line, which is a straight line connecting adjacent fiber bundles, with respect to the longitudinal direction of ribbon 150 generally agrees with the winding angle that is the angle of the longitudinal direction of ribbon 150 with respect to the circumferential direction of shaft 130.

If the ribbon brush as shown in FIG. 5 is used as a lubricant application brush, a section on image carrier 60 supplied with lubricant and a section not supplied with lubricant show up at regular intervals. Accordingly, the friction coefficient of the surface of image carrier 60 periodically varies. In this manner, if the friction coefficient of the surface of image carrier 60 varies from one place to another, the transfer performance and the development performance as well as the potential state of image carrier 60 varies. Therefore, streak noise appears particularly in a halftone image.

(d5: Means to Solve the Problem)

In the present embodiment, in order to prevent streak noise as described above, a ribbon brush designed according to the concept below is used for the lubricant application brush. More specifically, the configuration is different from the state shown in FIG. 5 in that the arrangement angle that is the angle of the arrangement line, which is the straight line connecting adjacent fiber bundles, with respect to the longitudinal direction of ribbon 150 differs from the winding angle that is the angle of the longitudinal direction of ribbon 150 with respect to the circumferential direction of shaft 130.

Figure 7A:
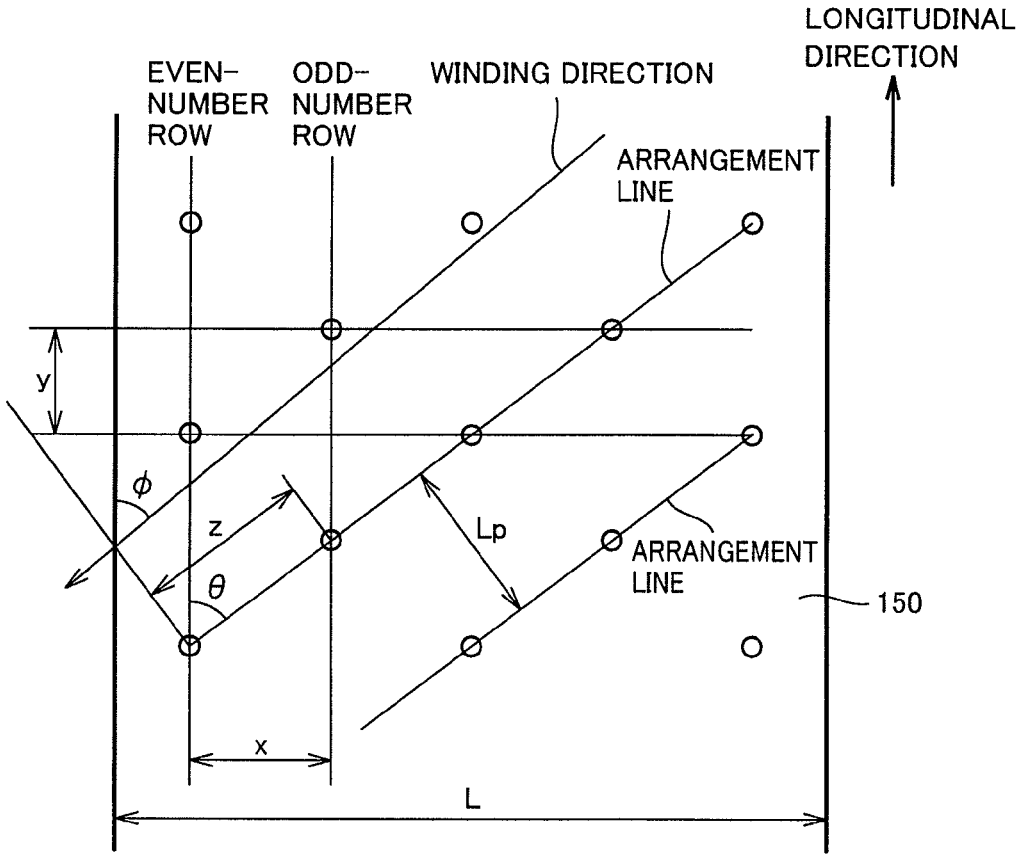
FIGS. 7A and 7B are schematic diagrams for explaining a method of calculating an arrangement line and an arrangement line spacing of the ribbon.
Figure 7B:
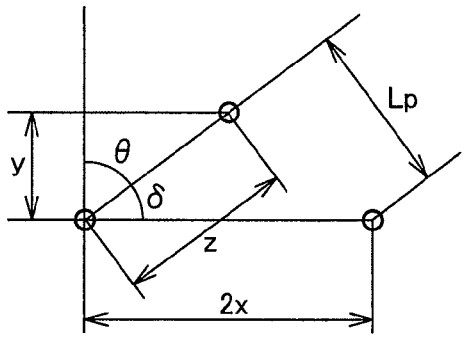

Referring to FIGS. 7A and 7B, the arrangement line and the spacing between arrangement lines (arrangement line spacing Lp) will be described in connection with the spacing of fiber bundles 100 that constitute ribbon 150. FIGS. 7A and 7B are schematic diagrams for explaining a method of calculating the arrangement line and the spacing between arrangement lines in ribbon 150.

As shown in FIG. 7A, let x be the distance between fiber bundle 100 arranged on an even-number row and fiber bundle 100 arranged on an odd-number row, y be the distance between a certain fiber bundle 100 on an even-number row and fiber bundle 100 closest thereto on an odd-number row with respect to the longitudinal direction of ribbon 150, and 9 be the angle between the arrangement line and the longitudinal direction of ribbon 150 (arrangement angle). Furthermore, let Lp be the distance between two adjacent arrangement lines (arrangement line spacing Lp). Then, the relation between the arrangement line spacing Lp and the distances x and y can be expressed as an equation (2) below.

$$Lp=2\times x\times y/(x^2+y^2)^{1/2} \quad (2)$$

The more specific calculation procedure is as shown in FIG. 7B. Letting z be the distance between two adjacent fiber bundles 100 on a common arrangement line, $z=(x^2+y^2)^{1/2}$ holds. When the complementary angle of the arrangement angle $\theta$ is $\delta$, $\sin\delta=y/z=y/(x^2+y^2)^{1/2}$ holds. Here, $Lp=2\times x\times\sin\delta$, and then, the equation (2) above is derived.

Figure 8A:
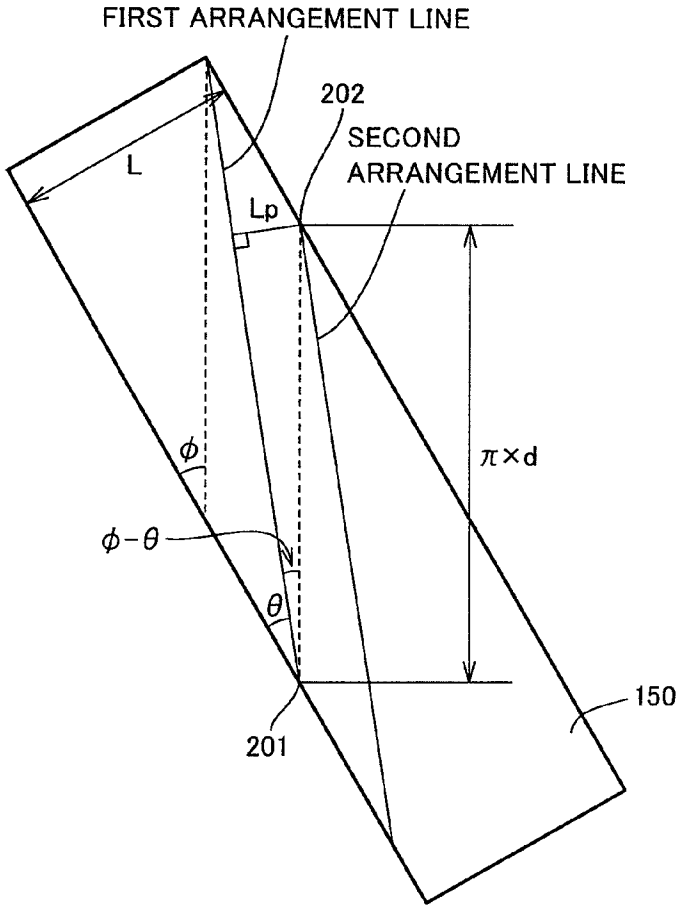
FIGS. 8A and 8B are schematic diagrams for explaining the relation between a ribbon winding angle, an arrangement angle, and an arrangement line spacing for a ribbon brush according to the embodiment of the invention.
Figure 8B:
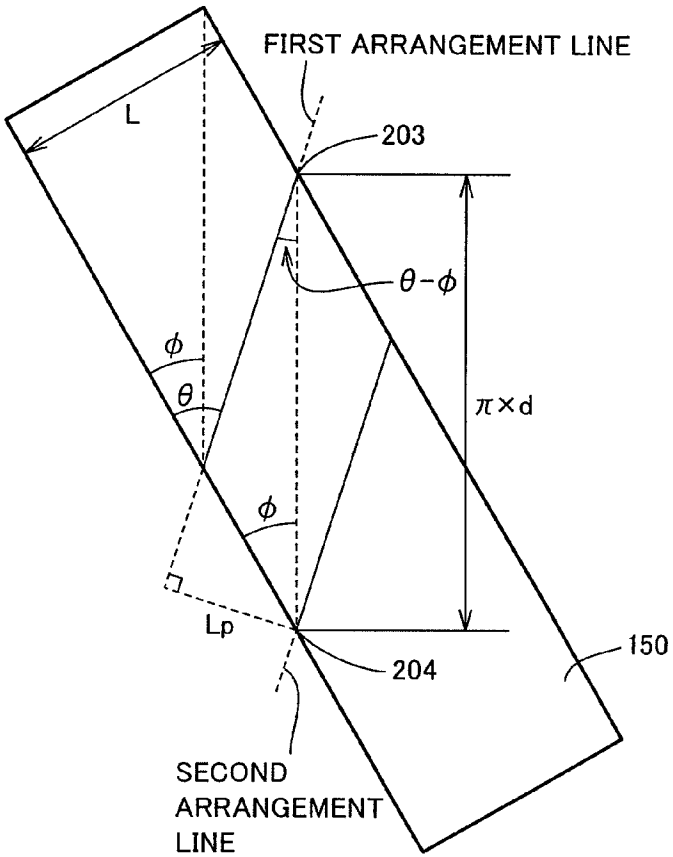

FIGS. 8A and 8B are schematic diagrams for explaining the relation between the ribbon winding angle $\phi$, the arrangement angle $\theta$ and the arrangement line spacing Lp for the ribbon brush according to the present embodiment. FIG. 8A shows a case where the winding angle $\phi$ is greater than the arrangement angle $\theta$, and FIG. 8B shows a case where the winding angle $\phi$ is smaller than the arrangement angle $\theta$. Although different kinds of arrangement lines can be defined, a group of arrangement lines defined by the angle closest to the rotational direction of shaft 130 will be considered in the description below.

In order to prevent streak noise, it is preferable to meet a condition that a section where fiber bundle 100 does not come into contact with image carrier 60 is not produced. More specifically, for a group of arrangement lines defined by the angle closest to the rotational direction of shaft 130, it is preferable that a certain arrangement line be wound so as to at least intersect the adjacent arrangement line in one rotation of the ribbon around shaft 130.

Under this condition, as shown in FIG. 8A, the arrangement line spacing Lp is maximum when the lower end point of the first arrangement line (a point of intersection 201 with the end surface of ribbon 150) is coincident with the upper start point of the second arrangement line (a point of intersection 202 with the end surface of ribbon 150) in the brush circumferential direction (the broken line between the point of intersection 201 and the point of intersection 202 agrees with the winding direction). Alternatively, as shown in FIG. 8B, the arrangement line spacing Lp is maximum when the upper end point of the first arrangement line (a point of intersection 203 with the end surface of ribbon 150) is coincident with the lower start point of the second arrangement line (a point of intersection 204 with the end surface of ribbon 150) in the brush circumferential direction (the broken line between the point of intersection 203 and the point of intersection 204 agrees with the winding direction).

The arrangement line spacing Lp is maximized under the condition above in the state shown in FIG. 8A or FIG. 8B. When the arrangement line spacing Lp is greater than this value, a section where fiber bundle 100 does not come into contact with image carrier 60 may appear.

As shown in FIG. 8A, when the winding angle $\phi$ is greater than the arrangement angle $\theta$, Lp that satisfies the condition above can be expressed as an equation (3).

$$Lp \leq \pi \times d \times \sin(\phi - \theta) \quad (3)$$

As shown in FIG. 8B, when the winding angle $\phi$ is smaller than the arrangement angle $\theta$, Lp that satisfies the condition above can be expressed as an equation (4).

$$Lp \leq \pi \times d \times \sin(\phi - \theta) \quad (4)$$

The equations (3) and (4) are generalized as an equation (5).

$$Lp \leq \pi \times d \times \sin(|\phi - \theta|) \quad (5)$$

An equation (6) can be obtained from the equations (1) and (5).

$$Lp \leq L \times \sin(|\phi - \theta|)/\sin \phi \quad (6)$$

The equation (6) means the condition that the arrangement line spacing Lp, which is the shortest distance between the adjacent arrangement lines, should satisfy in order to prevent streak noise, for a group of arrangement lines defined by the angle closest to the rotational direction of shaft 130, where the winding angle is $\phi$, the arrangement angle is $\theta$, and the ribbon width is L. In other words, the loop brush configured to satisfy the condition represented by the equation (6) can be used in the lubricant application mechanism to prevent streak noise.

The changing upper limit value of the arrangement line spacing Lp with respect to the winding angle $\phi$ in a case where the fiber density (the distance y between fiber bundles 100 in the longitudinal direction) is changed will be considered below according to the equations (2) and (6).

Figure 9:
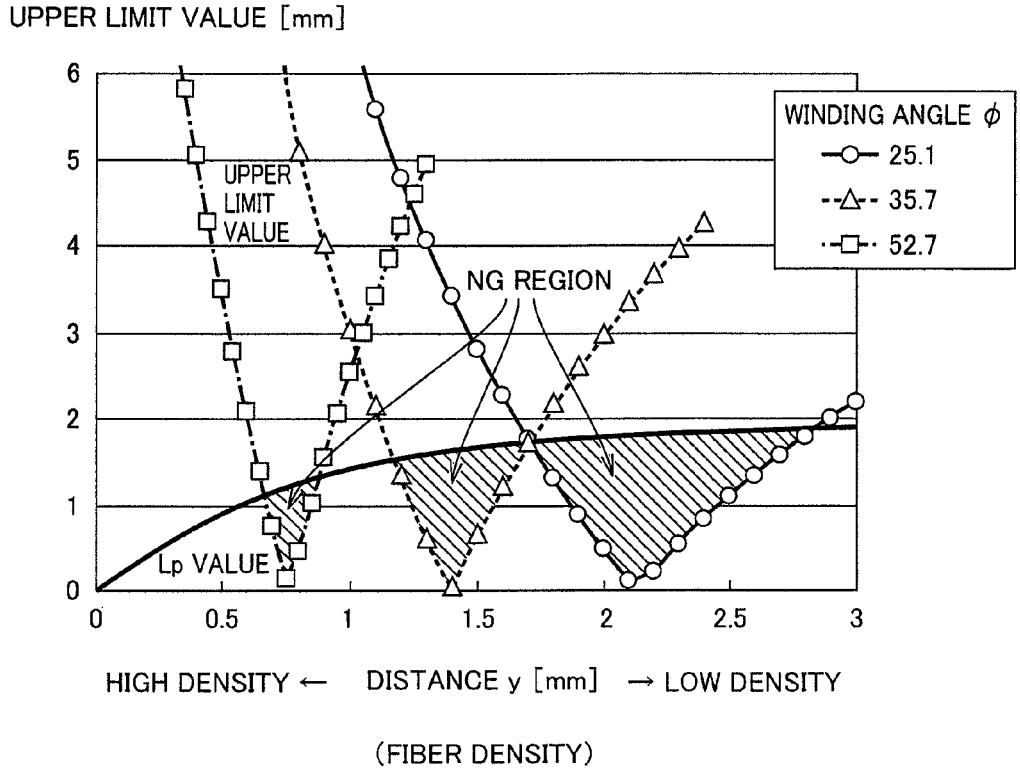
FIG. 9 is a graph showing a changing upper limit value of the arrangement line spacing in connection with a fiber density for the ribbon brush according to the embodiment of the invention.

FIG. 9 is a graph showing the changing upper limit value of the arrangement line spacing Lp in connection with the fiber density for the ribbon bush according to the embodiment of the present invention. In FIG. 9, a region in which the calculated arrangement line spacing Lp exceeds the permissible upper limit is shown as an NG region (the hatched region).

In the calculation example shown in FIG. 9, the distance x between fiber bundles 100 was 1 mm, and the shaft diameter d was 6 mm. Then, three different winding angles $\theta$ are set by changing the ribbon width L. As shown in FIG. 9, the fiber density corresponding to the region (NG region) in which the calculated arrangement line spacing Lp exceeds the permissible upper limit value varies according to the winding angle $\phi$. The fiber density is shifted toward the higher side when the winding angle $\theta$ is increased. It is understood that the NG fiber density region is reduced as the winding angle $\phi$ is increased.

[E. Evaluation Example]

Different kinds of loop brushes were prepared based on the technical concept as described above. The results of testing their performance will be described.

The image forming apparatus of bizhub C6500 (print performance: A4Y 60 sheets/min) manufactured by Konica Minolta Business Technologies, Inc. was modified into the configuration described above and used in the test.

The test conditions are as follows. Under the environment at a temperature of 23° C. and a humidity of 65%, 5000 sheets of a test chart including a solid image at a 0% image density and a solid image equivalent to a 100% image density were printed in a monochrome mode in succession. After the printing of 5000 sheets, a halftone image was printed, and streak noise and a density variation between 0% image and 100% image in the print result were evaluated.

Lubricant application mechanism 80 and the solid lubricant as illustrated in FIG. 1 and FIG. 2 were used. The compression spring was adjusted so as to apply a pressing force of 4 N/m to lubricant application brush 81. Polyurethane rubber having a JIS-A hardness of 72 degrees and a rebound resilience of 25% was used as cleaning blade 24. The abutment force of cleaning blade 24 against image carrier 60 was 25 N/m and the abutment angle was 15°.

As for the lubricant application brush, ribbons having different fiber densities were prepared by changing the distance y between fiber bundles 100 in the longitudinal direction, from 0.25 mm to 1.6 mm. Ribbons having different widths were also prepared by changing the ribbon width L at a 2 mm pitch from 10 mm to 16 mm. Ribbons having different loop heights were used by changing the height of the loop of fiber bundle 100. These ribbons were each wound around a core having a shaft diameter of 6 mm to form a brush roll. In the table below, $\phi$12 represents an example having a loop height of 0.5 mm, and $\phi$13 represents an example having a loop height of 1.0 mm. The endurance test results are shown below.

TABLE 1

| | brush parameter | | | | calculated value | | | | endurance evaluation result | | | |
|---|---|---|---|---|---|---|---|---|---|---|---|---|
| | | | | | | | | | Φ12 | | Φ13 | |
| | X | y | d | L | $\phi$ | $\theta$ | Lp | upper limit value | streak noise | density variation | streak noise | density variation |
| Example 1 | 1 | 1.6 | 6 | 12 | 39.5 | 32.0 | 1.70 | 2.47 | B | A | A | A |
| Example 2 | 1 | 1.6 | 6 | 14 | 48.0 | 32.0 | 1.70 | 5.18 | B | A | A | A |
| Example 3 | 1 | 1 | 6 | 12 | 39.5 | 45.0 | 1.41 | 1.79 | B | A | B | A |
| Example 4 | 1 | 1 | 6 | 16 | 58.1 | 45.0 | 1.41 | 4.27 | B | A | A | A |
| Example 5 | 1 | 0.6 | 6 | 12 | 39.5 | 59.0 | 1.03 | 6.29 | A | A | — | — |
| Example 6 | 1 | 0.6 | 6 | 14 | 48.0 | 59.0 | 1.03 | 3.62 | A | A | — | — |
| Example 7 | 1 | 0.4 | 6 | 12 | 39.5 | 68.2 | 0.74 | 9.04 | A | B | — | — |
| Example 8 | 1 | 0.4 | 6 | 14 | 48.0 | 68.2 | 0.74 | 6.52 | A | B | — | — |
| Example 9 | 1 | 0.4 | 6 | 16 | 58.1 | 68.2 | 0.74 | 3.31 | A | B | — | — |
| Comparative Example 1 | 1 | 0.25 | 6 | 10 | 32.0 | 76.0 | 0.49 | 13.08 | A | C | — | — |
| Comparative Example 2 | 1 | 0.25 | 6 | 12 | 39.5 | 76.0 | 0.49 | 11.19 | A | C | — | — |
| Comparative Example 3 | 1 | 0.25 | 6 | 14 | 48.0 | 76.0 | 0.49 | 8.85 | A | C | — | — |
| Comparative Example 4 | 1 | 1.6 | 6 | 10 | 32.0 | 32.0 | 1.70 | 0.01 | C | A | — | — |

TABLE 1-continued

| | brush parameter | | | | calculated value | | | | endurance evaluation result | | | |
|---|---|---|---|---|---|---|---|---|---|---|---|---|
| | | | | | | | | | Φ12 | | Φ13 | |
| | X | y | d | L | ϕ | θ | Lp | upper limit value | streak noise | density variation | streak noise | density variation |
| Comparative Example 5 | 1 | 1 | 6 | 14 | 48.0 | 45.0 | 1.41 | 0.97 | C | A | — | — |
| Comparative Example 6 | 1 | 0.6 | 6 | 16 | 58.1 | 59.0 | 1.03 | 0.31 | C | A | — | — |

In the endurance evaluation results above, for each item, "A" indicates a level that poses no problem, "B" indicates a level that is observable in the image but poses no problem in practice, and "C" indicates a level that is observable in the image and poses a problem in practice.

Example 1 to Example 9 and Comparative Example 1 to Comparative Example 3 are the cases that satisfy the condition in the equation (6) for the arrangement line spacing Lp and the upper limit value of the arrangement line spacing Lp. In these experimental examples, of the endurance evaluation results, the results for streak noise are good. By contrast, Comparative Example 4 to Comparative Example 6 are the cases that do not satisfy the condition in the equation (6) for the arrangement line spacing Lp and the upper limit value of the arrangement line spacing Lp. In these experimental examples, of the endurance evaluation results, the results for streak noise are bad.

Looking at the relation between the arrangement line spacing Lp and the upper limit value of the arrangement line spacing Lp, and the evaluation results for streak noise, it can be said that the validity of the design approach according to the embodiment as described above is verified.

Example 1 to Example 6 are the examples in which the arrangement line spacing Lp exceeds 1 mm, whereas Example 7 to Example 9 are the examples in which the arrangement line spacing Lp falls below 1 mm. Of the endurance test results, the evaluation result for density variation is "A" in Example 1 to Example 6, whereas the evaluation result is "B" in Example 7 to Example 9. Comparative Example 1 to Comparative Example 3 are the examples in which the arrangement line spacing Lp falls below 0.5 mm. In these examples, of the endurance evaluation results, the evaluation result for density variation is "C." Therefore, the arrangement line spacing Lp is to be configured such that at least Lp≥0.5 mm is met.

Looking at the evaluation results for density variation, it can be assumed that toner deposited in the brush because of a too high fiber density inhibits the friction coefficient from being reduced and thus causes density variations.

Looking at Example 1 to Example 4, the scraping ability becomes higher as the loop height increases, and, as a result, streak noise can be reduced.

Streak noise occurs noticeably in the image density 0% section. The reason may be as follows. The difference in friction coefficient between a section in abutment with the fiber bundles and a section not in abutment is increased to cause streak noise, and a significant difference occurs particularly under the condition in which the friction coefficient decreases.

In the image density 0% section, toner is not adhered to lubricant application brush 81 and the ability of scarping off the lubricant becomes high. Thus, streak noise occurs noticeably in the image density 0% section. As for the density variation, the density is high in image density 0% section, whereas the density is low in the image density 100% section. This phenomenon can be attributable to the same reason. In the image density 100% section, a large amount of toner is adhered to lubricant application brush 81, and the ability of scraping off the lubricant becomes low. Therefore, the friction coefficient is not reduced in the image density 100% section.

The reason why the image density becomes high when the friction coefficient is reduced and the image density becomes low when the friction coefficient is not reduced is that the transfer efficiency greatly varies depending on the friction coefficient. The smaller is the friction coefficient, the better is the transfer efficiency. Therefore, if there is a difference in friction coefficient on image carrier 60, density variation and/or streak noise appears.

[F. Design Procedure]

The procedure for designing the lubricant application brush based on the discussion above will be described.

Figure 10:
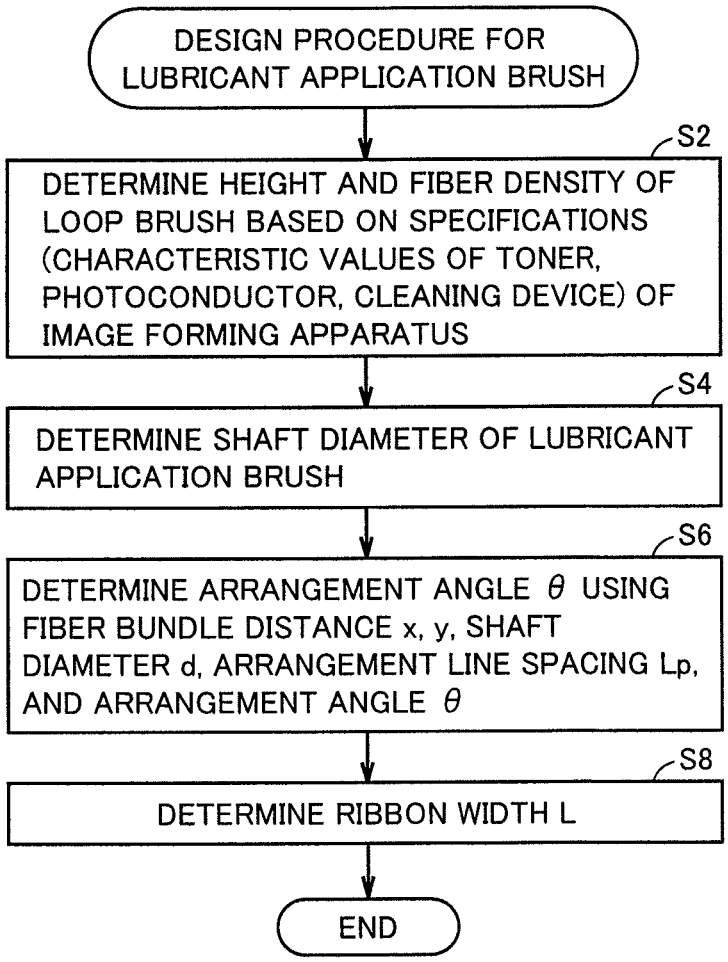
FIG. 10 is a flowchart showing a design procedure of a lubricant application brush according to the embodiment of the invention.

FIG. 10 is a flowchart showing the design procedure for the lubricant application brush according to the embodiment of the present invention. Referring to FIG. 10, first, the height and the fiber density of the loop brush are determined based on the specifications (the characteristic values of toner, the image carrier, and the cleaning device) of the image forming apparatus provided with lubricant application mechanism 80 (step S2). Then, the shaft diameter of the lubricant application brush is determined (step S4). Based on the parameters determined in steps S2 and S4, the distances x and y between fiber bundles, the shaft diameter d, the arrangement line spacing Lp, and the arrangement angle θ are determined. Therefore, the arrangement angle θ is determined using those parameters (step S6). Then, the ribbon width L is determined so as to satisfy the equation (6) above (step S8).

Through the procedure like this, the lubricant application brush that satisfies the conditions described above, that is, with less streak noise and density variation, can be designed.

[G. Advantages]

The present embodiment solves the problem when a loop brush that prevents lubricant from being shaved in a shape of comb teeth and increases the stability in supplying the enduring solid lubricant is used as the lubricant application brush. More specifically, the degree of fiber unevenness on the brush surface is greater in a loop brush than in a straight-bristle brush. As a result, with some combinations of the shaft diameter, the ribbon width, and the density of the brush, the fiber bundles generally line up in the brush circumferential direction, causing uneven supply of the lubricant to the image carrier. This may cause streak noise in an image. Then, in the present embodiment, streak noise is prevented by changing the ribbon width and changing the winding angle around the shaft.

In this manner, the adoption of the configuration according to the present embodiment almost eliminates a section where the brush fiber bundle does not come into abutment with the image carrier. As a result, streak noise due to uneven supply of lubricant can be effectively prevented. In addition, the brush can always be kept clean because there is no need for increasing the fiber density more than necessary. Thus, the performance of lubricant application is not impaired.

As described above, in the present embodiment, even when a loop brush is used as the solid lubricant application brush, streak noise due to uneven supply of lubricant and density variations due to brush contamination can be prevented.

Although the present invention has been described and illustrated in detail, it is clearly understood that the same is by way of illustration and example only and is not to be taken by way of limitation, the scope of the present invention being interpreted by the terms of the appended claims.

What is claimed is:

1. A loop brush comprising:

a shaft; and a ribbon having loop-shaped fiber bundles arranged regularly on a base cloth, and being wound around said shaft at a prescribed angle, wherein an arrangement angle that is an angle of an arrangement line, which is a straight line connecting adjacent said fiber bundles, with respect to a longitudinal direction of said ribbon differs from a winding angle that is an angle of the longitudinal direction of said ribbon with respect to a circumferential direction of said shaft.

2. The loop brush according to claim 1, wherein said ribbon is wound such that, for a group of arrangement lines defined by an angle closest to a rotational direction of said shaft, an arrangement line at least intersects an arrangement line adjacent thereto in one rotation of said ribbon around said shaft.

3. The loop brush according to claim 1, wherein, for a group of arrangement lines defined by an angle closest to a rotational direction of said shaft, an arrangement line spacing Lp that is the shortest distance between adjacent arrangement lines satisfies $$Lp \leq L \cdot \sin(|\phi - \theta|)/\sin\phi,$$

where said winding angle is $\phi$, said arrangement angle is $\theta$, and a width of said ribbon is L.

4. The loop brush according to claim 3, wherein said arrangement line spacing Lp is 0.5 mm or more.

5. A lubricant application mechanism comprising:

a loop brush; and a solid lubricant arranged so as to be pressed against said loop brush, said loop brush including a shaft, and a ribbon having loop-shaped fiber bundles arranged regularly on a base cloth, and being wound around said shaft at a prescribed angle, wherein an arrangement angle that is an angle of an arrangement line, which is a straight line connecting adjacent said fiber bundles, with respect to a longitudinal direction of said ribbon differs from a winding angle that is an angle of the longitudinal direction of said ribbon with respect to a circumferential direction of said shaft.

6. The lubricant application mechanism according to claim 5, wherein said ribbon is wound such that, for a group of arrangement lines defined by an angle closest to a rotational direction of said shaft, an arrangement line at least intersects an arrangement line adjacent thereto in one rotation of said ribbon around said shaft.

7. The lubricant application mechanism according to claim 5, wherein, for a group of arrangement lines defined by an angle closest to a rotational direction of said shaft, an arrangement line spacing Lp that is the shortest distance between adjacent arrangement lines satisfies $$Lp \leq L \cdot \sin(|\phi - \theta|)/\sin\phi,$$

where said winding angle is $\phi$, said arrangement angle is $\theta$, and a width of said ribbon is L.

8. The lubricant application mechanism according to claim 7, wherein said arrangement line spacing Lp is 0.5 mm or more.

9. An image forming apparatus comprising:

a loop brush;

a solid lubricant arranged so as to be pressed against said loop brush;

an image carrier supplied with part of said solid lubricant with rotation of said loop brush; and a cleaning device in abutment with said image carrier, said loop brush including a shaft, and a ribbon having loop-shaped fiber bundles arranged regularly on a base cloth, and being wound around said shaft at a prescribed angle, wherein an arrangement angle that is an angle of an arrangement line, which is a straight line connecting adjacent said fiber bundles, with respect to a longitudinal direction of said ribbon differs from a winding angle that is an angle of the longitudinal direction of said ribbon with respect to a circumferential direction of said shaft.

10. The image forming apparatus according to claim 9, wherein said ribbon is wound such that, for a group of arrangement lines defined by an angle closest to a rotational direction of said shaft, an arrangement line at least intersects an arrangement line adjacent thereto in one rotation of said ribbon around said shaft.

11. The image forming apparatus according to claim 9, wherein, for a group of arrangement lines defined by an angle closest to a rotational direction of said shaft, an arrangement line spacing Lp that is the shortest distance between adjacent arrangement lines satisfies $$Lp \leq L \cdot \sin(|\phi - \theta|)/\sin\phi,$$

where said winding angle is $\phi$, said arrangement angle is $\theta$, and a width of said ribbon is L.

12. The image forming apparatus according to claim 11, wherein said arrangement line spacing Lp is 0.5 mm or more.

* * * * *